United States Patent [19]

Maruyama et al.

[11] Patent Number: 4,882,257

[45] Date of Patent: Nov. 21, 1989

[54] ELECTROPHOTOGRAPHIC DEVICE

[75] Inventors: Akio Maruyama, Tokyo; Teigo Sakakibara, Yokohama; Yuichi Hashimoto, Tokyo, all of Japan

[73] Assignee: Canon Kabushiki Kaisha, Tokyo, Japan

[21] Appl. No.: 197,962

[22] Filed: May 24, 1988

[30] Foreign Application Priority Data

May 27, 1987 [JP] Japan ..... 62-128064

[51] Int. Cl.[4] ..... G03G 13/22

[52] U.S. Cl. ..... 430/100; 430/120; 430/56; 430/58; 430/59

[58] Field of Search ..... 430/100, 120, 58, 59, 430/56

[56] References Cited

U.S. PATENT DOCUMENTS

| | | | |
|---|---|---|---|
| 3,251,685 | 5/1966 | Bickmore | 430/120 X |
| 4,123,270 | 10/1978 | Heil et al. | 96/1.5 |
| 4,247,614 | 1/1981 | Ohta et al. | 430/79 |
| 4,251,613 | 2/1981 | Sasaki et al. | 430/72 |
| 4,251,614 | 2/1981 | Sasaki et al. | 430/79 |
| 4,256,821 | 3/1981 | Enomoto et al. | 430/59 |
| 4,260,672 | 4/1981 | Sasaki et al. | 430/72 |
| 4,268,596 | 5/1981 | Sasaki et al. | 430/72 |
| 4,278,747 | 7/1981 | Murayama et al. | 430/82 |
| 4,293,628 | 10/1982 | Hashimoto et al. | 430/58 |
| 4,622,280 | 11/1986 | Makino et al. | 430/76 X |
| 4,761,359 | 8/1988 | Sakai et al. | 430/126 |

*Primary Examiner*—Paul R. Michl

*Assistant Examiner*—Jeffrey A. Lindeman

*Attorney, Agent, or Firm*—Fitzpatrick, Cella, Harper & Scinto

[57] ABSTRACT

An electrophotographic device performing reversal development to develop the portion with lower absolute value of potential in an electrophotographic process having steps of primary charging, imagewise exposure, developing and cleaning, and having a photosensitive member of the lamination type which uses a layer coated with an organic pigment dispersed in a solvent or in a solvent and a polymer binder, as the charge generation layer, wherein the potential of the photosensitive member and process conditions are under constant conditions, said constant conditions being within the range as defined by the following formula of Vd, t and $V_H$, when the surface potential of the photosensitive member immediately after charged with a primary charger is defined as Vd (V), the time from primary charging to toner development as t (sec) and further the surface potential of the photosensitive member at which the toner developing density becomes the half value of the saturated density as $V_H$ (V):

$$|V_H| \leqq (|Vd|^{-0.65} + 1.35 \times 10^{-2} t)^{-1.54}$$

(Vd, $V_H$ are of the same sign:); with proviso, in the case of bias exposure (image exposure is also effected on the white background portion), Vd shall be the potential immediately after imagewise exposure, and t the time from imagewise exposure to toner development.

6 Claims, 6 Drawing Sheets

ELECTROPHOTOGRAPHIC DEVICE

BACKGROUND OF THE INVENTION

1. Field of the Invention

This invention relates to an electrophotographic device, particularly an electrophotographic device of the reversal developing system by use of an organic photosemiconductor type photosensitive member.

2. Related Background Art

Electrophotographic processes may be classified largely into two systems of positive developing and reversal developing from the viewpoint of the developing system.

In the basic electrophotographic processes of primary charging of photosensitive member, formation of latent image on the photosensitive surface by image exposure, toner development and cleaning, positive developing effects toner development of the portion on the photosensitivve member where no imagewise exposure is effected, or the portion with relatively smaller dose of photoirradiation, in other words the portion with higher absolute value of the photosensitive member surface potential, while the reversal developing is contrariwise the system of toner development of the lower absolute value of the photosensitive surface potential, and therefore development is performed by use of a toner of the same polarity as primary charging.

In the prior art, the system generally employed as the electrophotographic device is positive developing, but in recent years reversal developing systems have been utilized widely in a printer for microfilm, an electrophotographic system printer by use of laser as the light source (laser printer), etc.

As the photosensitive member for electrophotography, selenium, selenium alloys, cadmium sulfide resin dispersion system, amorphous silicon, organic photosemiconductor (OPC) have been employed, and among them OPC is attracting much attention recently and is going to be practically applied widely for its high productivity and cheap production cost.

Since discovery of specific organic compounds which exhibit photoconductivity, a large number of organic photoconductors have been developed. For example, there have been known organic photoconductive polymers such as poly-N-vinylcarbazole, polyvinylanthracene, etc., low molecular weight organic photoconductors such as carbazole, anthracene, pyrazolines, oxadiazoles, hydrazones, polyarylalkanes, etc., organic pigments or dyes such as phthalocyanine pigments, azo pigments, cyanine dyes, polycyclic quinone pigments, perylene type pigments, indigo dyes, thioindigo dyes, or squaric acid methine dyes, etc.

Particularly, organic pigments and dyes having photoconductivity can be synthesized more easily than inorganic materials, and yet expanded in variation to select compounds exhitibing photoconductivity at appropriate wavelength region, and therefore a large number of photoconductive organic pigments and dyes have been proposed.

For example, as disclosed in U.S. Pat. Nos. 4,123,270, 4,247,614, 4,251,613, 4,251,614, 4,256,821, 4,260,672, 4,268,596, 4,278,747, 4,293,628, an electrophotographic photosensitive member by use of a disazo pigment exhibiting photoconductivity as the charge generation material in the photosensitive layer separated in function into the charge generation layer and the charge transport layer has been known, and since the electrophotographic photosensitive member by use of such organic photoconductive member can be produced by coating by selecting appropriately the binder, it has many advantages that productivity is extremely high and cheap photosensitive members can be provided, and yet the photosensitive wavelength region can be freely controlled by selection of the organic pigment.

The laminated type photosensitive member obtained by laminating a charge transport layer and a charge generation layer composed mainly of the charge generation material is more advantageous in sensitivity and elevation of residual potential after durability test than the single layer type photosensitive member.

In the laminated type photosensitive member, the charge generation layer can be formed by coating a charge generation material such as phthalocyanine pigment, dibenzpyrene pigment, azo pigment, etc. and, if desired, a charge transport layer together with a binder (or without binder) on a substrate, and also can be obtained by forming a vapor deposited film by vacuum vapor deposition device, but for easiness of formation, the coating system is principally practiced presently.

However, here when a charge generation layer on which an organic pigment is coated as the charge generation material is used, local charge injection points are formed on the coated surface due to unevenness of particle size and agglomeration mutually between pigment particles during coating, whereby points of particular large dark decay are formed locally, and therefore when such materials are applied as the photosensitive member to form copied images, the above-mentioned local charge injection points will appear as the image defect.

Particularly, when such photosensitive member is used in a copying machine which performs reversal development the local charge injection points of the charge generation layer by use of the pigment as described above become the points with lower absolute values of surface potential as compared with other points, then these points will become the image defect in black spot by toner development.

SUMMARY OF THE INVENTION

An object of the present invention is to improve the above drawbacks and provide an electrophotographic device which performs reversal developing by use of a laminated type electrophotographic photosensitive member in which a charge generation layer of the organic pigment dispersing type is used, capable of supplying images with no image defect at all.

The present invention is intended to accomplish the above object by setting following conditions at a certain relationship: the potential immediately after primary charging, the time from charging to developing and the potential at which the toner developing density becomes the half value.

More specifically, the present invention relates to an electrophotographic device performing reversal development to develop the portion with lower absolute value of potential in an electrophotographic process having steps of primary charging, imagewise exposure, developing and cleaning, and having a photosensitive member of the lamination type by use of a layer coated with an organic pigment dispersed in a solvent or in a solvent and in a polymer binder, as the charge generation layer, wherein the potential of the photosensitive member and process conditions are under constant conditions, said constant conditions being within the range as defined by the following formula of Vd, t and $V_H$, when the surface potential of the photosensitive member immediately after charged with a primary charger is defined as Vd (V), the time from primary charging to toner development as t (sec) and further the surface potential of the photosensitive member at which the toner developing density becomes the half value of the saturated density as $V_H$ (V):

$$|V_H| \leqq (|Vd|^{-0.65} + 1.35 \times 10^{-2} t)^{-1.54}$$

(Vd, $V_H$ are of the same sign.); with proviso, in the case of bias exposure (image exposure is also effected on the white background portion), Vd shall be the potential immediately after imagewise exposure, and t the time from imagewise exposure to toner development.

An another aspect of this invention relates to an electrophotographic process performing reversal development to develop the portion with lower absolute value of potential and performing at least primary charging, imagewise exposure, developing and cleaning on a photosensitive member of the lamination type which uses a layer coated with an organic pigment dispersed as the charge generation layer, wherein the potential of the photosensitive member and process conditions are under constant conditions, said constant conditions being within the range as defined by the following formula of Vd, t and $V_H$, when the surface potential of the photosensitive member immediately after charged with a primary charger is defined as Vd (V), the time from primary charging to toner development as t (sec) and further the surface potential of the photosensitive member at which the toner developing density becomes the half value of the saturated density as $V_H$ (V):

$$|V_H| \leqq (|Vd|^{-0.65} + 1.35 \times 10^{-2} t)^{-1.54}$$

(Vd, $V_H$ are the same sign); with proviso, in the case of bias exposure (image exposure is also effected on the white background portion), Vd shall be the potential immediately after imagewise exposure, and t the time from imagewise exposure to toner development.

DESCRIPTION OF THE PREFERRED EMBODIMENTS

Figure 1:
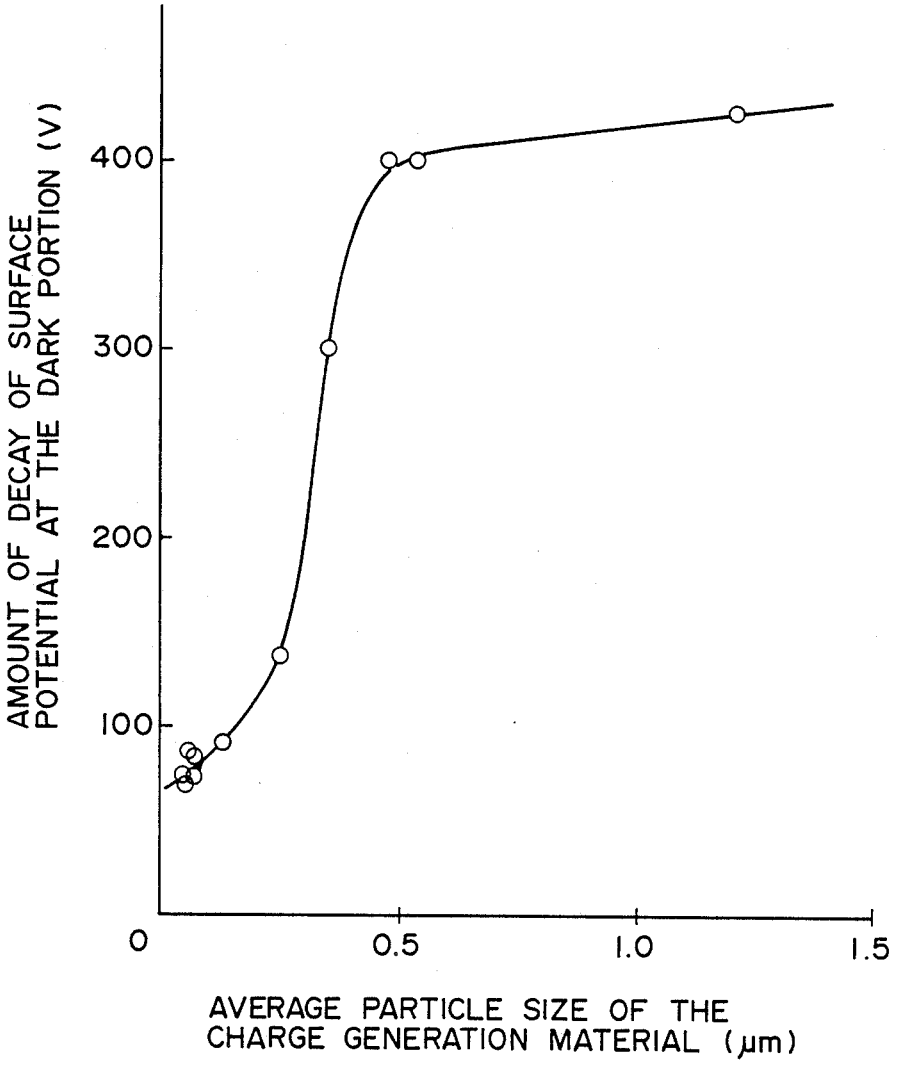
FIG. 1 is a graph showing the relationship between the average particle size of the charge generation material and the amount of decay of surface potential at the dark portion.

In the present invention, photosensitive layer is the function separation type, and a laminated type photosensitive member which has a layer coated with a dispressed organic pigment, a charge generation material, as the charge generation layer, and has further a charge transport layer thereon, is used.

Decay of the surface potential of the photosensitive member after charging at the dark portion depends greatly on the characteristics of the charge generation layer.

More specifically, injection of charges from the substrate into the charge generation layer, the amount of thermal charges within the charge generation layer, the amount of photocharges accumulated within the charge generation layer by photoirradiation before charging are intimately related with the coated state of the charge generation layer.

These relationships are described on the basis of an experimental example.

As the experiment material, a solution of 10 parts by weight of a copolymerized nylon resin (trade name: Toresin, produced by Toray K.K.) dissolved in a mixture comprising 60 parts by weight of methanol and 40 parts by weight of butanol was applied by dipping on the surface of an electroconductive substrate of a thin aluminum plate to provide an intermediate layer of polyamide of 2.0 μm thickness.

Next, 1 part by weight of ε-type copper phthalocyanine (trade name: Lionol Blue ES, produced by Toyo Ink K.K.), 1 part by weight of a butyral resin (trade name: Ethlec BM-2, produced by Sekisui Kagaku K.K.) and 10 parts by weight of cyclohexanone were dispersed together with 50 parts by weight of glass beads of 1 mm diameter by a sand mill disperser, with the dispersing time being varied from 0 min. to 20 hours, to prepare 13 kinds of dispersions.

The dispersing time and the average particle size of ε-type copper phthalocyanine of these dispersions are shown below.

| Dispersing time (min.) | Average particle size (μm) |
|---|---|
| 0 | 1.2 |
| 1 | 0.53 |
| 5 | 0.46 |
| 10 | 0.35 |
| 30 | 0.25 |
| 60 | 0.13 |
| 120 | 0.09 |
| 180 | 0.08 |
| 300 | 0.07 |
| 420 | 0.07 |
| 600 | 0.06 |
| 900 | 0.05 |
| 1200 | 0.05 |

Note:
The sample with dispersing time of 0 min. was obtained by merely shaking the mixture with glass beads.

Each solution was applied as the coating liquid on the above intermediate layer, followed by drying at 100° C. for 5 minutes to provide a charge generation layer with a thickness of 10 μm.

As another samples, by use of a dispersion with the dispersing time of 1200 minutes as the coating solution, charge generation layers with film thicknesses of 0.1 μm, 0.2 μm, 0.4 μm, 0.7 μm, 1.0 μm, 1.5 μm, 2.0 μm, 3.0 μm, 5.0 μm, were coated on the above intermediate layer, followed by drying, to provide 9 kinds of charge generation layers with different film thicknesses.

Subsequently, 10 parts by weight of a hydrazone compound of the following structural formula:

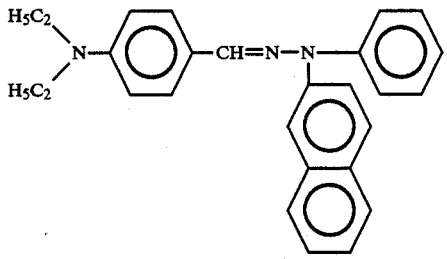

and 15 parts by weight of a styrene-methyl methacrylate copolymer (trade name: MS 200, produced by Shinnittetsu Kagaku K.K.) were dissolved in 90 parts by weight of toluene to prepare a coating solution, which was applied by dipping on the charge generation layer. After standing for 10 minutes, the coating was dried by heating at 100° C. for one hour to prepare a charge transport layer with a thickness of 16 μm.

Figure 2:
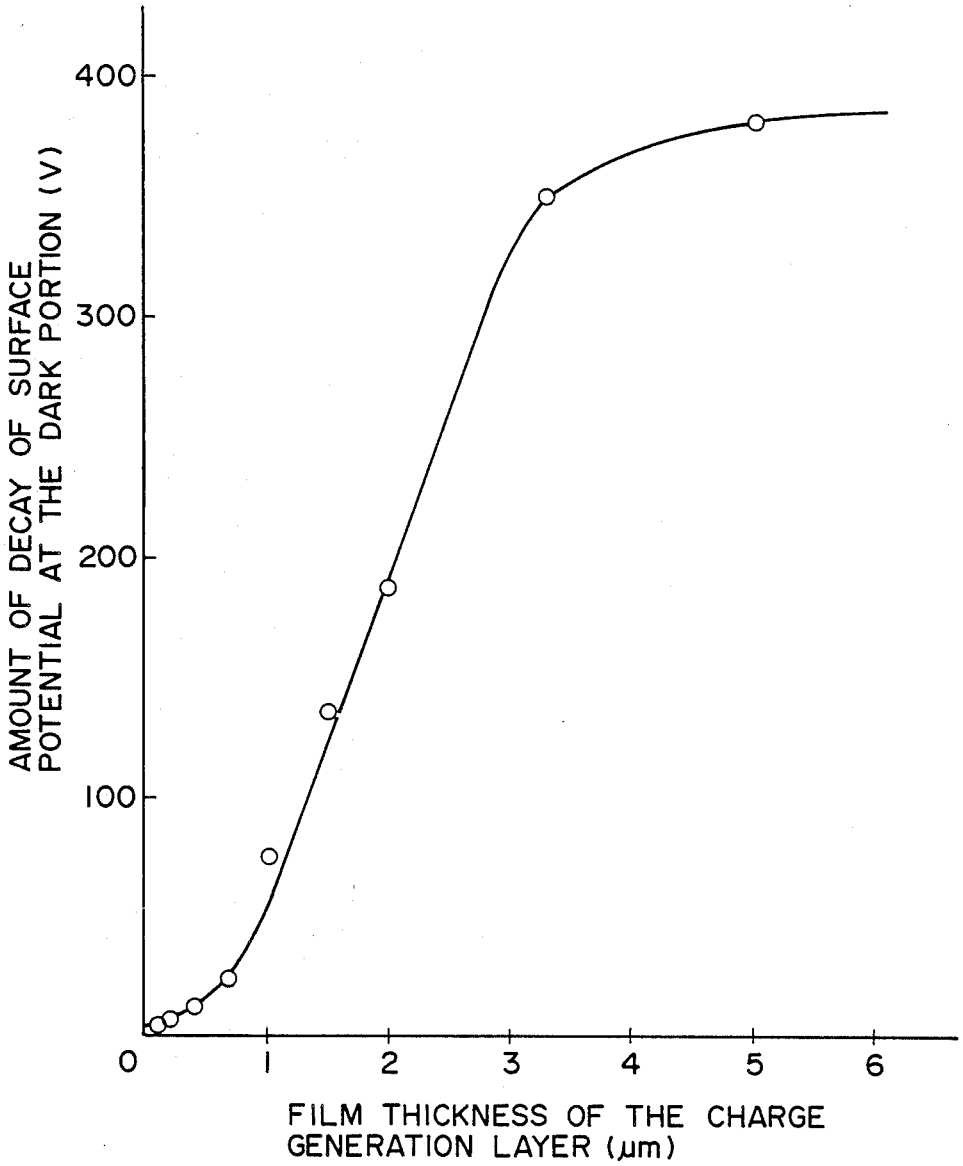
FIG. 2 is a graph showing the relationship between the film thickness of the charge generation layer and the amount of decay of surface potential at the dark portion.

The electrophotographic photosensitive member thus prepared was charged to −700 V by corona charging (negative polarity), and thereafter the amount of decay of surface potential at the dark portion for 1 second was measured to obtain the results shown in FIGS. 1 and 2.

FIG. 1 shows the relationship between the average particle size of the charge generation material and the amount of decay of surface potential at the dark portion, FIG. 2 the relationship between the film thickness of the charge generation layer and the amount of decay of surface potential at the dark portion.

From the results shown in FIGS. 1 and 2, it can be seen that there is a tendency to decay of surface potential as the dark portion, namely increase of amount of charges injected at the dark position from the charge generation layer to the charge transport layer, and the injected amount of charges being saturated above a certain value, as the average particle size of the charge generation material is larger, and also as the film thickness of the charge generation layer is thicker.

This is an example of the ε-type phthalocyanine, but also the same tendency is observed in case of a charge generation layer of another organic pigment dispersion system is used.

Thus, the amount of charges injected from the charge generation layer into the charge transport layer is intimately related with the particle size of the organic pigment and the film thickness of the charge generation layer, but when a dispersion of the organic pigment is used for making the charge generation layer, the particle size and film thickness are very nonuniform and of broad distribution on the coated surface of practical photosensitive member.

More specifically, as the method for dispersing the organic pigment, roll mill, ball mill, vibrating ball mill, attritor, sand mill, colloid mill, etc. are used, but even if the particle size of the organic pigment dispersed according to these methods may become smaller on an average, large particles will always exist.

Even if these large particles are removed by filtration etc., due to agglomerating tendency of the pigment itself, the average particles tend to be increased during storage of the dispersion.

Further, also during coating, agglomeration of organic pigments occurs with the flaws on a substrate, dust attached on a concavity or substrate and so on as the nucleus, whereby portions with large particle size tend to be formed locally by forming coated film from the state of coating solution.

Next, concerning the film thickness of the charge generation layer, a thicker portion with locally will always exist due smoothness of a substrate and agglomeration of the organic pigment as mentioned above.

Tendency of agglomeration of pigments during coating according to various causes depends greatly on the distribution of particle sizes of the pigments in a coating solution before coating.

As the result of investigation of the particle size distribution of the pigments of the coating solution before coating and the agglomerating tendency during coating, it has been found that abrupt agglomerating tendency is increased when relatively larger particles exist in a certain amount or more.

Specifically, pigments with particle sizes of 0.5 μm or more are particularly increased in agglomerating tendency.

Figure 3:
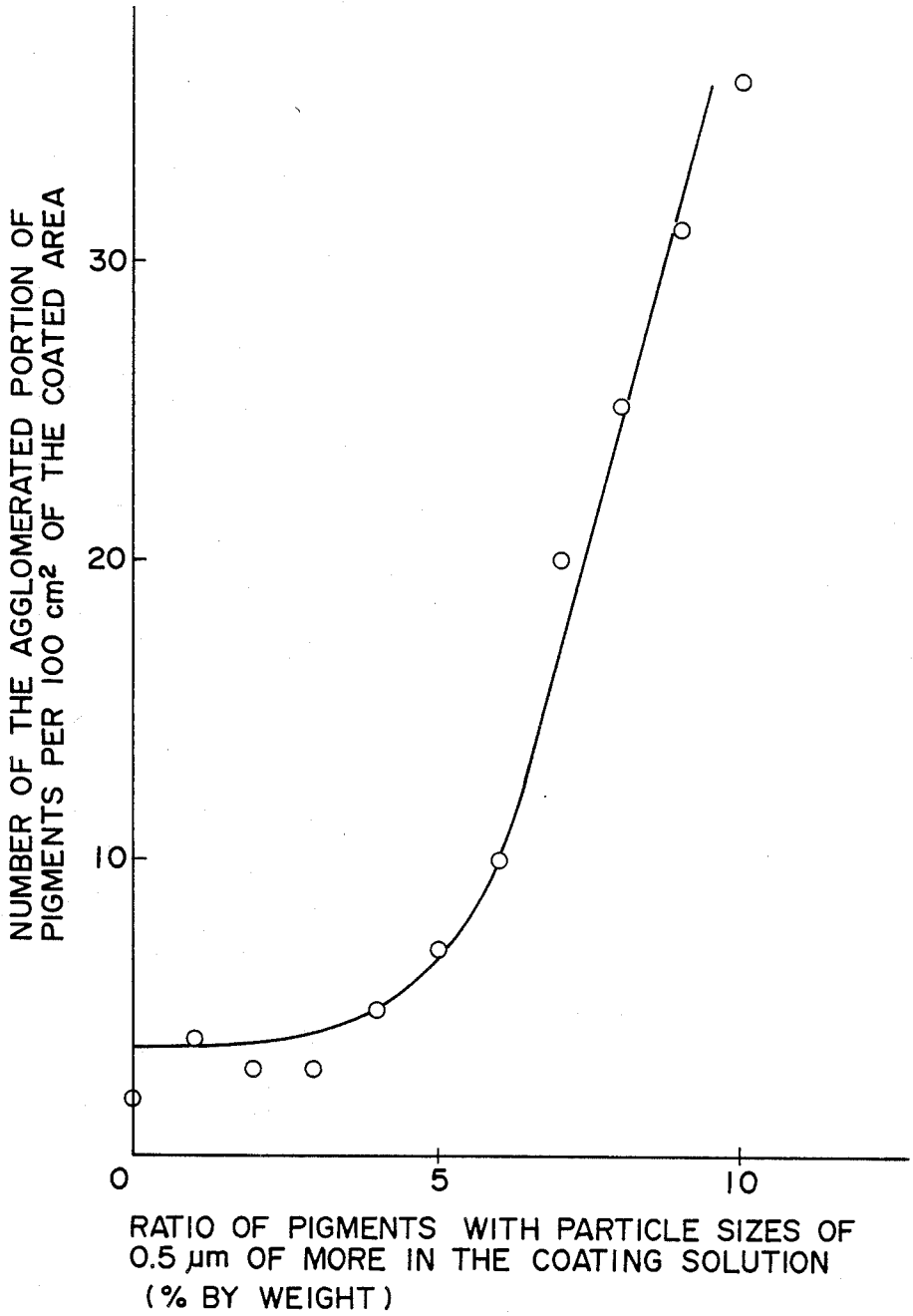
FIG. 3 is a graph showing the relationship between the ratio of pigments with particle sizes of 0.5 μm or more in the coating solution when applied by dipping on the aluminum substrate and the number of the agglomerated portion of pigments with particle sizes of 50 μm or more per 100 $cm^2$ of the coated area, with the μ-type copper phthalocyanine as an example.

FIG. 3 shows the relationship between the ratio of pigments with particle sizes of 0.5 μm or more in the coating solution when applied by dipping on the aluminum substrate and the number of the agglomerated portion of pigments with particle sizes of 50 μm or more per 100 $cm^2$ of the coated area, with the ε-type copper phthalocyanine as an example.

As shown from FIG. 3, there is the tendency that the number of the agglomerated portions is abruptly increased when the ratio of the pigments with particle sizes of 0.5 μm or more is 5% by weight or more, and therefore particularly when a photosensitive member prepared by coating with the use of a coating solution containing 5% by weight or more of pigments of 0.5 μm or more, it becomes necessary to cope with the image defect by such agglomeration.

As described above, due to the problems in dispersion of organic pigments or in coating, there exist portions with large pigment particle sizes or portions with thick films locally on the coated surface of the charge generation layer, and in such portions, injection of charges from the charge generation layer into the charge transport layer is more as compared with other portions as shown in FIGS. 1 and 2.

Therefore, when this is used as the photosensitive member for electrophotography, there exists the portion where the absolute value of the surface potential becomes lower than other portions locally even at the dark portion. Particularly, when used as the photosensitive member for electrophotography for performing reversal developing, the portion with locally lower value of potential is toner developed to give image defect.

The present invention prevents the defect of copied images generated due to nonuniformity of the charge generation layer as described above, and therefore as a result of the study about charge injectability from the charge generation layer to the charge transport layer at the dark portion, decay at the dark portion of the surface potential at the portion where the charge injectability caused by the charge generation layer becomes the maximum is determined as the approximation formula, and the process conditions for the electrophotographic device without image defect have been found based on the formula.

More specifically, it has been rendered possible to provide an electrophotographic device which repeats the basic processes of primary charging, image exposure, developing, cleaning, without image defect, by performing process designing under the conditions to satisfy the relationship:

$$|V_H| \leqq (|Vd|^{-0.65} + 1.65 \times 10^{-2} t)^{-1.54}$$

(Vd, $V_H$ are of the same sign) wherein Vd(V) is the surface potential of the photosensitive member immediately after charging by the primary charger, t(sec) is the time from primary charging to toner developing, and $V_H$(V) is the surface potential of the photosensitive member at which the toner developing density becomes the half value of the saturated concentration.

Figure 4:
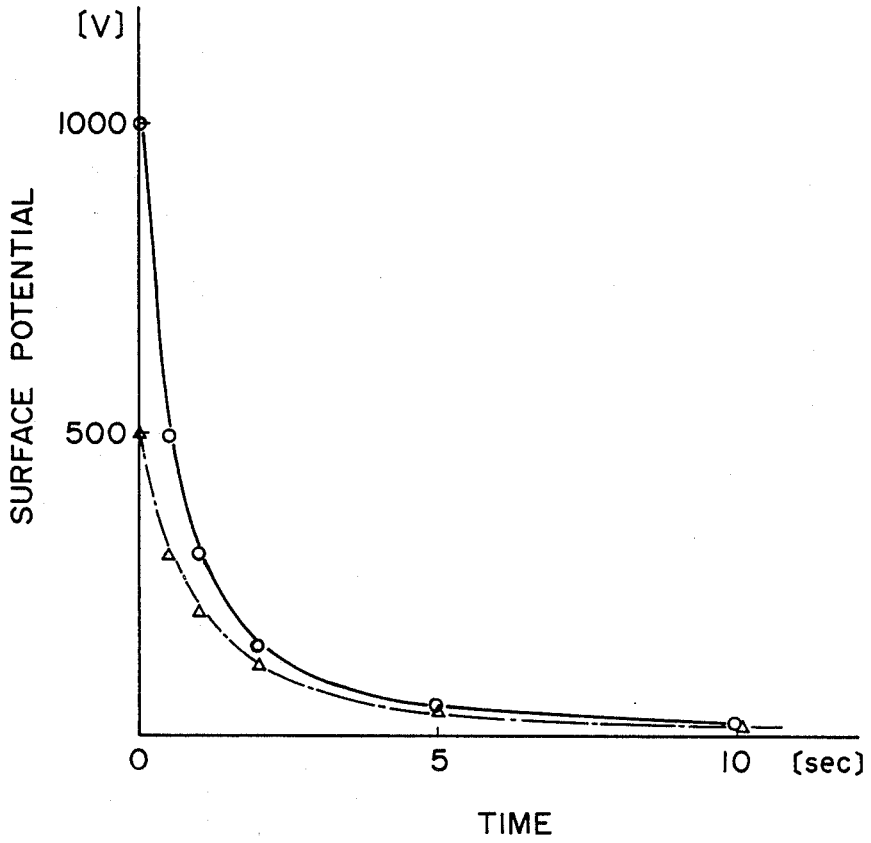
FIG. 4 is a graph showing the result to measure the decay of the surface potential depending upon the time at the dark portion, after the electrophotographic photosensitive member is charged by corona charging.
Figure 5:
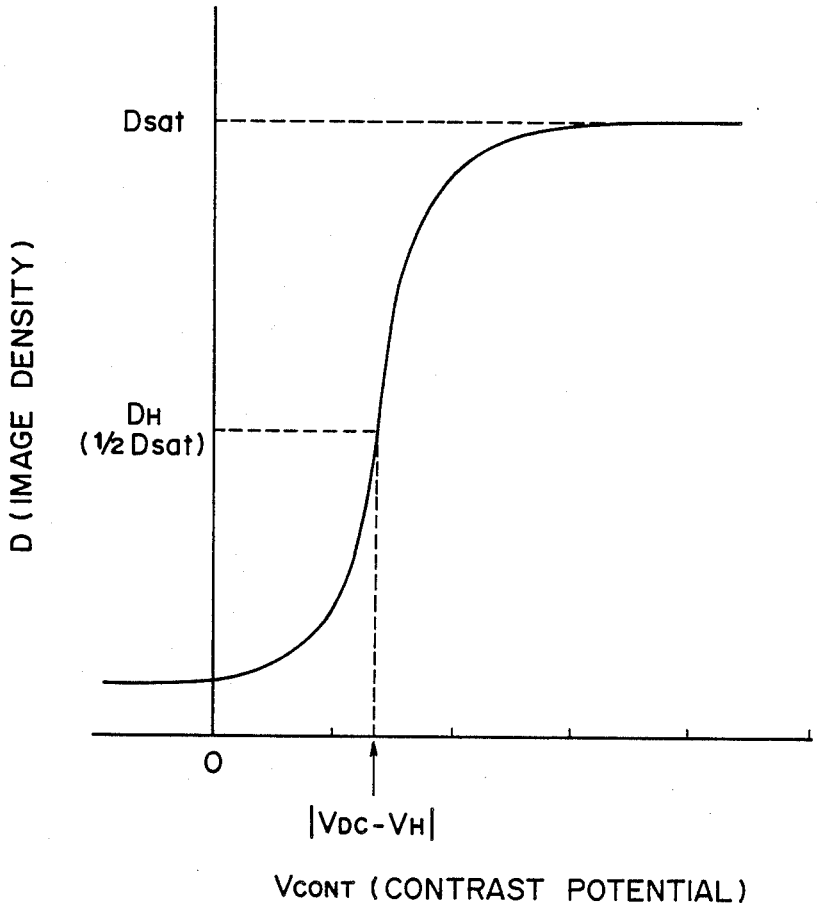
FIG. 5 is a graph showing the relationship between the constant potential and the image density. $V_{DC}$ is a direct current component of development bias.

This formula is made based upon the experimental data shown in FIG. 4. FIG. 4 shows the result to measure the decay of the surface potential depending upon the time at the dark portion, after the electrophotographic photosensitive member, which has charge generating material of average particle size 1.2 μm as shown in FIG. 1, is charged to −1000V and −500V by corona charging (negative polarity), in order to simulate the decay curve of the surface potential at the agglomerated portions in the charge generation layer. The decay curve of the surface potential is generally considered as a space charge controlled current, then J, charge to be injected, can be indicated as $$J = kV^a$$

where k and a are constant, V is a voltage effected on the photosensitive member.

When the differential equation is solved, as $$J = dV/dt,$$

$$V = \{|Vd|^{1/1-a} + Kt\}^{1-a} \quad (1)$$

is introduced.

When one substitutes the measured results of the decay curve of the surface potential shown in FIG. 4 for the above equation, Equation (1) has the highest relation coefficient at $K = 1.35 \times 10^{-2}$ and $a = 2.54$.

In addition, $V_H$ means the value of the surface potential of photosensitive member when $D_{sat}$ (saturated image density) becomes half ($D_H$).

Figure 6:
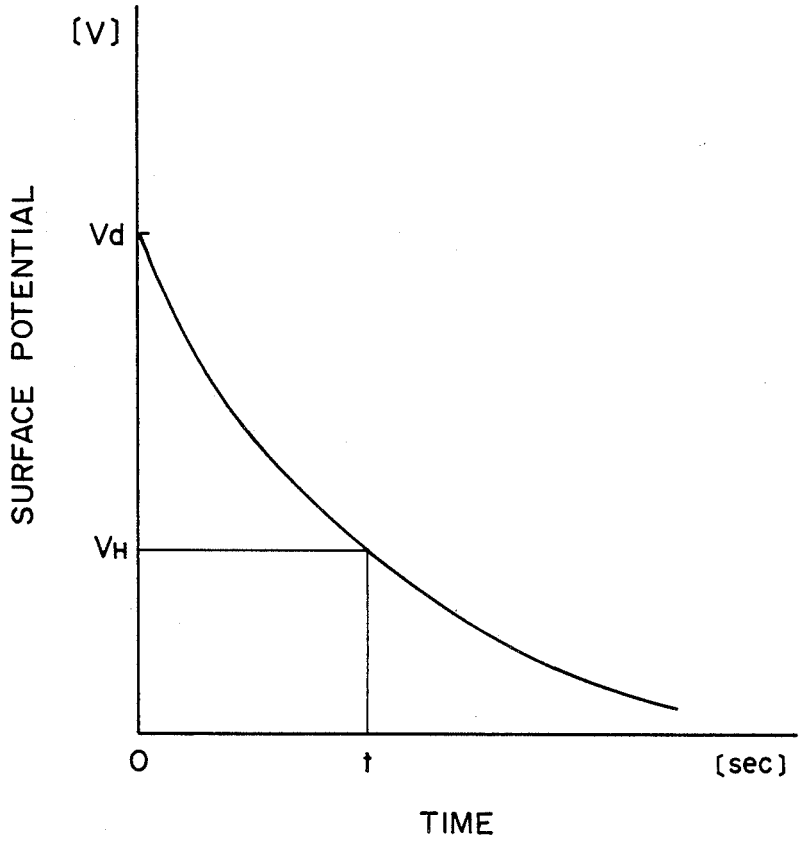
FIG. 6 is a typical decay curve of the surface potential at the agglomerated portions of pigment in the charge generation layer.

And FIG. 6 shows typically the decay curve of the surface potential at the agglomerated portions of pigment in the charge generation layer, that is, when the surface potential at the agglomerated portions of pigment is within the time t (sec), under conditions that the surface potential is above $V_H$, the agglomerated portions of pigment is not subjected to toner development because its amount is very little, or even if subjected to toner development, the developed portion cannot be visually confirmed, then no problem occurs on the image.

In the instant invention, for the measurement of particle size the Ultra Centrifugal Automatic Measurement Apparatus for Particle Distribution (Type: CAPA-700), produced by Horiba Mfg. Co., was used. The particle size shall mean the weight average particle size value.

The instant invention is illustrated by following Example.

As the charge generation material, phthalocyanine type pigments, anthanthrone pigments, dibenzpyrene pigments, pyranthrone pigments, azo pigments, indigo pigments, quinacridone type pigments, pyrylium type pigments, thiapyrylium type pigments, xanthene type pigments, quinoneimine type pigments, triphenylmethane type pigments, styryl type pigments, etc. are exemplified.

Charge generation materials are not limited to those described here, but they can be used as one kind or as a mixture of two or more kinds.

The charge generation layer can be formed by coating the above-described charge generation material and, if desired, a charge transport material together with a suitable binder (or without binder) on a substrate.

The particle size of the charge generation material in dispersion may be preferably 3 μm or less, more preferbly 1 μm or less.

Coating may be performed by use of a coating method such as dip coating, spray coating, spinner coating, bead coating, Meyer bar coating, blade coating, roller coating, curtain coating, etc.

The charge transport layer is electically contacted with the above charge generation layer, and receives charge carriers injected from the charge generation layer in the presence of electrical fields, and has a function capable of transporting these charge carriers.

In this case, the charge transport layer is laminated in the charge generation layer.

The charge transport layer can be obtained by coating an organic charge transport material such as hydrazone type compounds, pyrazoline type compounds, stilbene type commands, oxazole type compounds, thiazole type compounds, triarylmethane type compounds, etc. optionally together with a binder resin. Also, inorganic semiconductor powder such as Zinc oxide, selenium, amorphous silicon sensitized with dye can be used, and further the transport layer can be also formed by vapor deposition of these materials.

EXAMPLE 1

Five cylindrical substrates made of aluminum having bottom were prepared. The cylinders had an average diameter of 60 mm, an average thickness of 0.5 mm and a length of 260 mm.

5 Kinds of photosensitive members were prepared by use of τ-type phthalocyanines with different dispersed particle sizes (produced by Toyo Ink K.K.) as the charge generation material. An electrophotographic device, for which a laser beam printer (LBP-CX, produced by Canon K.K.) of the reversal developing system having the steps of primary charging, image exposure, developing, transfer and cleaning modified so that setting of charging potential and process speed could be varied was used as the evaluation machine for evaluating images after setting the respective potentials and processes of the respective members.

Coating of the photosensitive member on the aluminum cylinder was performed as follows.

10 Parts by weight of titanium oxide powder coated with electroconductive tin oxide (produced by Titanium Kogyo K.K.) and 10 parts of titanium oxide powder (produced by Sakai Kagaku K.K.) were mixed in a solution comprising 17 parts by weight of a phenol resin (trade name: Plyofen J325, produced by Dainippon Ink K.K.), 3 parts by weight of methanol and 10 parts by weight of 2-methoxyethanol, and then dispersed in a ball mill. The electroconductive coating material was applied on each substrate by dipping, followed by curing at 140° C. for 20 minutes to form an electroconductive layer with a thickness of 20 μm. The electroconductive layer was provided for shielding fine flaws of about μm existing on the substrate.

Next, 4 parts by weight of a co-polymerized nylon (trade name: CM 8000, produced by Toray K.K.) and 4 parts of type 8 nylon (trade name: Lackamide 5003, produced by Dainippon Ink K.K.) were dissolved in 50 parts by weight of methanol and 50 parts of n-butanol, and applied on the above electroconductive layer by dipping to form a polyamide resin layer with a thickness of 0.6 μm as an undercoat layer.

Next, 1 part by weight of τ-type phthalocyanine, 1 part by weight of butyral resin (trade name: Ethlec BM-2, produced by Sekisui Kagaku K.K.) were dispersed together with 50 parts by weight of glass beads of 1 mm diameter in a sand mill disperser to prepare dispersions with average particle sizes after dispersion of 0.10 μm, 0.15 μm, 0.25 μm, 0.50 μm and 1.10 μm, respectively, which were applied on the above undercoat layer by dipping, followed by heating and drying at 100° C. for 10 minutes, to provide a charge generation layer with a coated film thickness of 1.5 μm.

Subsequently, 10 parts of a hydrazone compound of the following formula:

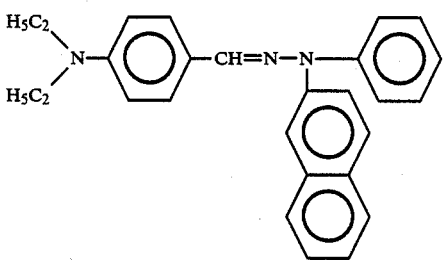

and 15 parts by weight of a styrene-methyl methacrylate copolymer (trade name: MS 200, produced by Shinnittetsu Kakagu K.K.) were dissolved in 90 parts by weight of toluene to provide a coating solution, which was applied on the charge generation layer by dipping. After left to stand for 10 minutes, the coating was heated and dried at 100° C. for 1 hour to form a charge transport layer with a thickness of 16 μm.

The 5 kinds of the electrophotographic photosensitive members thus prepared should be called Samples A, B, C, D and E in the order of smaller average particle size after dispersing the charge generation material.

By use of the photosensitive drums of the Samples A to E, image evaluation was conducted by means of the modified laser beam printer (LBP-CX) as described above.

First, by setting at Vd = −700 V and $V_H$ = −350 V, and varying the process speed, the number of black dot image defects in 100 $cm^2$ of white ground when t was varied was measured. The results were as follows:

| | Sample | | | | |
|---|---|---|---|---|---|
| t (sec) | A (0.10) | B (0.15) | C (0.25) | D (0.50) | E (1.10) (μm) |
| 0.3 | 0 | 0 | 0 | 0 | 0 |
| 0.5 | 0 | 0 | 0 | 0 | 0 |
| 0.6 | 0 | 0 | 0 | 0 | 0 |
| 0.8 | 0 | 2 | 15 | 23 | 45 |
| 1.2 | 5 | 25 | 45 | 68 | 89 |
| 1.5 | 13 | 80 | 93 | 135 | 186 |

Here, in the presetting, the time t which satisfies the conditions of:

$$|V_H| \leqq (|Vd|^{-0.65} + 1.35 \times 10^{-2} t)^{-1.54}$$

(Vd, $V_H$ are of the same sign.) becomes t≦0.60.

As shown by the above results, under the conditions which satisfies the above formula, no black dot image defect was generated at all in all of the Samples, but when otherwise t was made greater than 0.87, the black dot image defects were increased as t was increased.

Therefore, under the conditions which satisfies the above formula, it became possible to obtain good image without image defect at all in all of the samples.

Next, by setting at Vd = −800 V, t = 0.8 sec., and varying the developing direct current bias applied on the developing instrument, the number of the black dot image defects when $V_H$ was varied was measured to obtain the results shown below.

Here, the conditions of $V_H$ satisfying the condition of the formula is:

| $\lvert V_H \rvert \leqq 316.8$, $V_H < 0$ | | | | | |
|---|---|---|---|---|---|
| | Sample | | | | |
| $V_H$(−V) | A | B | C | D | E |
| 250 | 0 | 0 | 0 | 0 | 0 |
| 300 | 0 | 0 | 0 | 0 | 0 |
| 350 | 0 | 0 | 5 | 12 | 25 |
| 400 | 3 | 6 | 12 | 56 | 89 |
| 500 | 38 | 65 | 102 | 155 | 197 |

As shown from the results, also here at $V_H$ satisfying the above formula, no image defect was generated at all in all of the Samples, to make it possible to obtain good image.

Further, by setting VH = −450 V, t = 0.5 sec., the number of black dot image defects when Vd was varied was similarly measured to obtain the results chosen below.

Here, the condition of $V_H$ satisfying the conditions of the formula is:

| $\lvert Vd \rvert \geqq 881.4$, $Vd < 0$ | | | | | |
|---|---|---|---|---|---|
| | Sample | | | | |
| Vd (V) | A | B | C | D | E |
| 950 | 0 | 0 | 0 | 0 | 0 |
| 900 | 0 | 0 | 0 | 0 | 0 |
| 850 | 0 | 2 | 13 | 24 | 58 |
| 800 | 23 | 56 | 85 | 137 | 176 |

Also here, under the conditions of Vd satisfying the above formula, no image defect was generated at all in all of the Samples, to make it possible to obtain good image.

EXAMPLE 2

A cylindrical substrate made of aluminum was prepared according to the same method as in Example 1, and further similar electroconductive layer and undercoat layer were formed thereon.

Further, each 1 part by weight of the pigments of exemplary pigments (1)–(6) having the following structural formulae, 1 part by weight of a polycarbonate (trade name: Panlite L-1250) and 10 parts by weight of cyclohexane were dispersed together with 50 parts by weight of glass beads of 1 mm diameter in a sand mill disperser, and by controlling the dispersing time so that the average particle size after dispersing became 0.3 μm, 6 kinds of dispersions of charge generation materials were prepared.

The dispersion was applied by dipping on the above undercoat layer, followed by heating and drying at 100° C. for 10 minutes to provide a charge generation layer with a coating thickness of 0.7 μm.

Next, according to the same method as in Example 1, a charge transport layer was formed to prepare 6 kinds of electrophotographic photosensitive members.

Samples should be called F, G, H, I, J and K corresponding to the charge generation materials of exemplary pigments (1)–(6).

Charge generation materials:

Pigment (1)

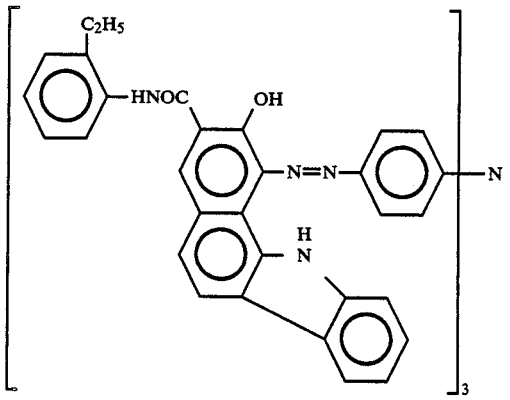

Pigment (2)

AlCl Phthalocyanine

Pigment (3)

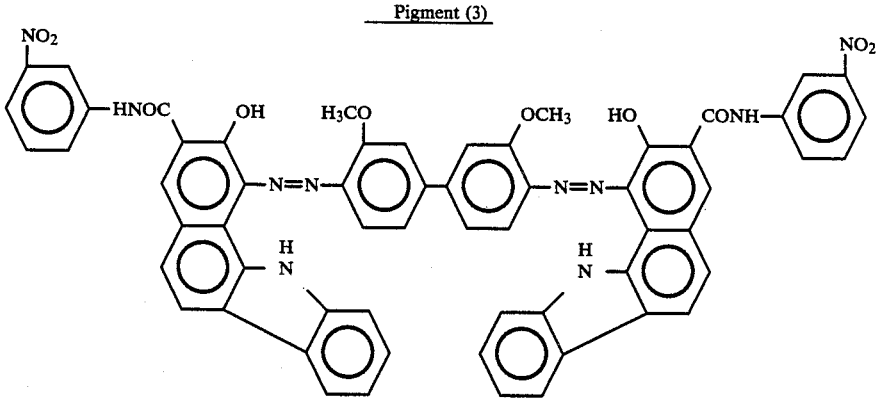

Pigment (4)

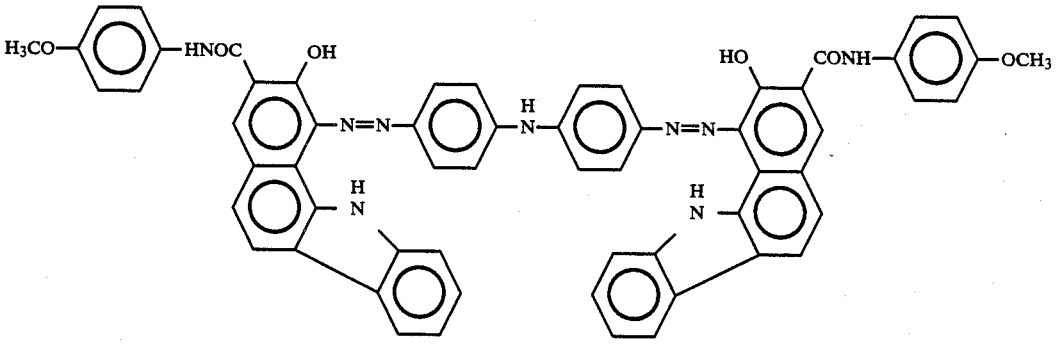

-continued

Pigment (5)

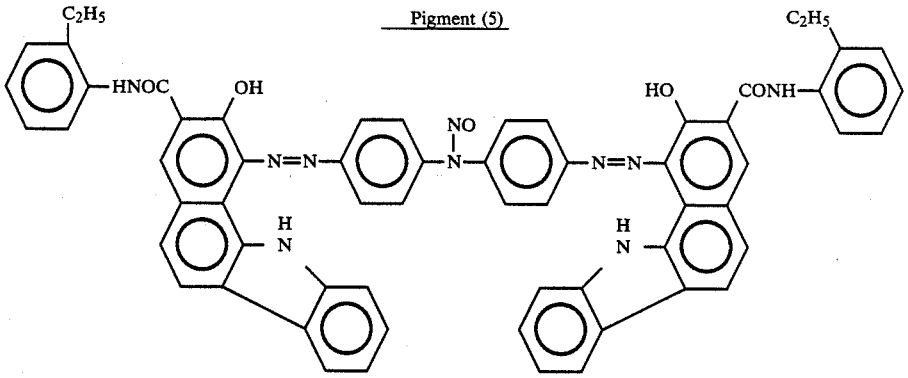

Pigment (6)

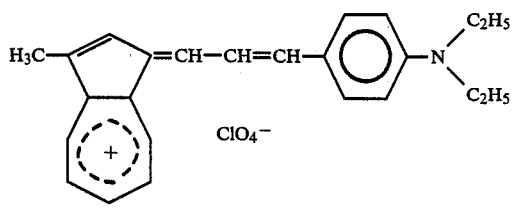

For the above Samples F–K, by means of the laser beam printer (modified machine of LBP-CX), by setting at Vd = −700 V, $V_H$ = −250 V, and by varying t (sec.) as 0.5, 0.7, 0.9, 1.2, 1.4, the number of the black dot image defects was measured. The results were as follows:

| t (sec) | Sample F (1) | G (2) | H (3) | I (4) | J (5) | K (6) | (pigment No.) |
|---|---|---|---|---|---|---|---|
| 0.5 | 0 | 0 | 0 | 0 | 0 | 0 | |
| 0.7 | 0 | 0 | 0 | 0 | 0 | 0 | |
| 0.9 | 0 | 0 | 0 | 0 | 0 | 0 | |
| 1.2 | 3 | 18 | 5 | 9 | 23 | 15 | |
| 1.4 | 62 | 105 | 75 | 83 | 165 | 108 | |

As shown here, in all of the photosensitive members of Samples F–K, the time satisfying the condition of:

$$|V_H| \leqq (|Vd|^{-0.65} + 1.35 \times 10^{-2} t)^{-1.54}$$

(Vd, $V_H$ are the same sign.) becomes t≦1.01, and within this range no black dot image defect was generated at all, whereby it could be understood that it became possible to obtain good image.

EXAMPLE 3

An aluminum cylindrical substrate with an average diameter of 80 mm was prepared according to the drawing working method and after mirror working was applied by cutting on its surface, an undercoat layer was formed according to the same method as in Example 1.

Further, on the undercoat layer was formed the charge generation layer according to the same method as Sample F in Example 2, followed further by formation of the charge transport layer according to the same method as in Example 1.

The electrophotographic photosensitive member thus prepared was subjected to evaluation by use of a copying machine (trade name NP-3525, produced by Canon K.K.) which was modified for reversal developing, and further modified so as to vary freely the process speed.

At Vd = −900 V, $V_H$ = −450 V, when t(sec.) was varied as 0.3, 0.5, 0.7, 0.9 and 1.2, the number of black dot image was measured similarly to obtain the following results. Here, t satisfying the conditions is t≦0.51.

| t (sec) | 0.3 | 0.5 | 0.7 | 0.9 | 1.2 |
|---|---|---|---|---|---|
| number of image defects | 0 | 0 | 12 | 39 | 145 |

As shown above, at t satisfying the conditions of the present invention, no black dot image defect was generated at all even in the experiments by use of the modified NP-3525 machine to give good image.

Further, even after successive image formation of 10,000 sheets of A4-form under the conditions of Vd = −700 V, $V_H$ = −450 V and t = 0.7 sec by means of the copying machine as described above (modified NP-3525 machine), images of good quality without image defect were obtained.

From the above results, when image formation is effect under the conditions of the present invention , it can be recognized that extremely good images without black dot defect can be obtained irrespectively of the difference in outer diameter of the photosensitive cylinder, form of copying machine.

We claim:

1. An electrophotographic process performing reversal development to develop the portion with lower absolute value of potential and performing at least primary charging imagewise exposure, developing and cleaning on a photosensitive member of the lamination type which uses a layer coated with a dispersed organic pigment as the charge generation layer, wherein the potential of the photosensitive member and process conditions are under constant conditions, said constant conditions being within the range as defined by the following formula of Vd, t and $V_H$, when the surface potential of the photosensitive member immediately after charged with a primary charger is defined as Vd (V), the time from primary charging to toner development as t (sec) and further the surface potential of the photosensitive member at which the toner developing density becomes the half value of the saturated density as $V_H$ (V):

$$|V_H| \leqq (|Vd|^{-0.65} + 1.35 \times 10^{-2} t)^{-1.54}$$

(Vd, $V_H$ are of the same sign.).

2. An electrophotographic process according to claim 1, wherein the photosensitive member has the charge generation layer obtained by applying the dispersion of the organic pigment containing 5% by weight or more of pigment with particle sizes of 0.5 μm or more.

3. An electrophotographic process according to claim 1, wherein the organic pigment is selected from the group consisting of phthalocyanine type pigments, anthanthrone pigments, dibenzpyrene pigments, pyranthrone pigments, azo pigments, indigo pigments, quinacridone type pigments, pyrylium type pigments, thiapyrilium type pigments, xasnthene type pigments, quinoneimine type pigments, triphenylmethane type pigments and styryl type pigments.

4. An electrophotographic process according to claim 1, wherein the organic pigment is phthalocyanine type pigment or azo pigment.

5. An electrophotographic process according to claim 1, wherein the photosensitive member is obtained by laminating the charge transport layer on the charge generation layer.

6. An electrophotographic process according to claim 1, wherein the charge transport material is selected from the group consisting of hydrazone type compounds, pyrazoline type compounds, stilbene type compounds, oxazole type compounds, thiazole type compounds and triarylmethane type compounds.

* * * * *

UNITED STATES PATENT AND TRADEMARK OFFICE

CERTIFICATE OF CORRECTION

PATENT NO. : 4,882,257

DATED : November 21, 1989

INVENTOR(S) : AKIO MARUYAMA, ET AL.

It is certified that error appears in the above-identified patent and that said Letters Patent is hereby corrected as shown below:

IN [57] ABSTRACT

Line 14, "charged" should read --being charged--.

COLUMN 1

Line 20, "photosensitivve" should read --photosensitive--.
Line 57, "exhitibing" should read --exhibiting--.

COLUMN 2

Line 36, "development" should read --development,--.

COLUMN 3

Line 4, "charged" should read --being charged--.
Line 18, "An another" should read --Another--.
Line 30, "charged" should read --being charged--.
Line 39, "are" should read --are of--.
Line 61, "μ-type" should read --ϵ-type--.

COLUMN 4

Line 10, "pressed" should read --persed--.

COLUMN 5

Line 1, "samples," should read --example,--.
Line 45, "dark position" should read --dark portion--.

UNITED STATES PATENT AND TRADEMARK OFFICE

CERTIFICATE OF CORRECTION

PATENT NO. : 4,882,257

DATED : November 21, 1989

INVENTOR(S) : AKIO MARUYAMA, ET AL.

It is certified that error appears in the above-identified patent and that said Letters Patent is hereby corrected as shown below:

COLUMN 6

Line 14, "with locally" should read --locally formed--.
Line 15, "due" should read --due to--.

COLUMN 7

Line 14, "$|V_H| \leqq (|V_d|^{-0.65} + 1.65X10^{-2}t)^{-1.54}$" should read --$|V_H| \leqq (|V_d|^{-0.65} + 1.35X10^{-2}t)^{-1.54}$--.
Line 16, "sign)" should read --sign);--.

COLUMN 8

Line 27, "electically" should read --electrically--.
Line 32, "laminated in" should read --laminated on--.
Line 50, "5 Kinds" should read --Five kinds--.
Line 64, "10 Parts" should read --Ten parts--.

COLUMN 10

Line 19, "satisfies" should read --satisfy--.
Line 23, "satisfies" should read --satisfy--.
Line 51, "chosen" should read --shown--.
Line 53, "$V_H$" should read --Vd--.

COLUMN 13

Line 54, "are" should read --are of--.

UNITED STATES PATENT AND TRADEMARK OFFICE

CERTIFICATE OF CORRECTION

PATENT NO. : 4,882,257

DATED : November 21, 1989

INVENTOR(S) : AKIO MARUYAMA, ET AL.

It is certified that error appears in the above-identified patent and that said Letters Patent is hereby corrected as shown below:

COLUMN 14

Line 62, "effect" should read --effected--.

COLUMN 15

Line 4, "charging" should read --charging,--.
Line 13, "charged" should read --being charged--.

COLUMN 16

Line 9, "xasnthene" should read --xanthene--.

Signed and Sealed this

Seventh Day of May, 1991

*Attest:*

HARRY F. MANBECK, JR.

*Attesting Officer*

*Commissioner of Patents and Trademarks*